United States Patent [19]

Holt

[11] 3,959,750

[45] May 25, 1976

[54] MICROWAVE DIODE SWITCH WHEREIN FIRST DIODE CARRIES GREATER CONTROL SIGNAL CURRENT THAN SECOND DIODE

[75] Inventor: Frank Holt, Hollis, N.H.

[73] Assignee: Sanders Associates, Inc., Nashua, N.H.

[22] Filed: May 22, 1975

[21] Appl. No.: 580,098

[52] U.S. Cl. ..... 333/97 S; 307/259; 333/7 D

[51] Int. Cl.[2] ..... H01P 1/15

[58] Field of Search ..... 333/7 D, 97 S; 307/259

[56] References Cited

UNITED STATES PATENTS

| | | | |
|---|---|---|---|
| 2,994,789 | 8/1961 | Gottfried | 307/259 |
| 3,295,138 | 12/1966 | Nelson | 333/7 D UX |
| 3,750,055 | 7/1973 | Funck | 333/7 D X |

*Primary Examiner*—Paul L. Gensler

*Attorney, Agent, or Firm*—Louis Etlinger; Joseph E. Funk

[57] ABSTRACT

A p-i-n diode microwave switch is disclosed capable of hot switching relatively high power microwave energy while maintaining high isolation between the input and outputs. To accomplish the high isolation at high power operating levels multiple p-i-n diodes are utilized with different forward and reverse bias potentials being applied to different diodes.

5 Claims, 5 Drawing Figures

MICROWAVE DIODE SWITCH WHEREIN FIRST DIODE CARRIES GREATER CONTROL SIGNAL CURRENT THAN SECOND DIODE

FIELD OF THE INVENTION

This invention relates to an improved diode switch used to pass high frequency electomagnetic energy. More particularly, it relates to a diode type microwave switch providing high isolation between the input and outputs.

BACKGROUND OF THE INVENTION

The use of diodes as microwave switches is well known in the art and they offer a number of advantages over mechanical switches. There are no moveable switch contacts with the attendant problem of noise due to poor connections. Diode switches can be fabricated at a lower cost than comparable mechanical switches. Diode switches can also be packaged in a smaller volume and, in particular, they are readily incorporated into transmission lines used to convey high frequency energy. Also, they are easily controlled from remote locations since the switching action is affected by means of switching and dc bias potentials applied to the switching diodes. Diode microwave switches typically use p-i-n diodes, well-known in the art, that are connected in shunt and series configurations to provide single-pole single-throw (SPST) and single-pole double-throw (SPDT) switches.

The radio frequency power that can be controlled by a p-i-n diode switch is determined by many factors well-known in the art. Several of these factors are: the frequency of the microwave energy passing through the diode, the speed at which the diodes are switched between their conducting and nonconducting states, the frequency at which the diodes are switched alternately between the conducting and nonconducting states, and the isolation level between the input and the outputs of a switch. These factors and the others not enumerated, coupled with a shunt configuration of the p-i-n diodes for maximum heat dissipation and fast switching speed, have resulted in microwave switches capable only of switching microwave power up to twenty watts of microwave energy.

In a typical p-i-n diode microwave switch isolation in the order of sixty decibels (db) between the input and output of the switch when the switch is open is required. In the art it is well-known that a single diode can typically provide in the order of 25 db isolation. Accordingly, multiple diodes are used to achieve the desired isolation, and typically three diodes are used to achieve sixty db isolation. As mentioned previously, diodes are connected in shunt across the transmission line conductors through the switch in order to achieve maximum power handling capability while achieving fast switch action. When such a switch is in its open state all the shunt connected diodes are placed in their conducting state in a manner well-known in the art. Vice versa, when such a switch is in a closed state the shunt connected diodes are caused not to conduct. Microwave energy input to a shunt connected switch in its open state divides and passes through the conducting multiple diodes to be reflected back to the input but the diodes do not conduct equal amounts of microwave energy. The one of the multiple shunt connected diodes upon which the input microwave energy is first incident conducts the largest portion of the microwave energy.

As a result, this first diode heats up and, in turn, the resistance of the diode increases and the diode conducts more microwave energy until a stable state is reached. In some instances the first diode may even burn out depending upon the amount of microwave energy input to the switch. The overheating of the first diode also causes the isolation between the input and output of the microwave switch in the open state to decrease. As the heating of the first diode causes its voltage drop to decrease, the amount of dc bias current passing through the first diode to maintain it in its conducting state also increases resulting in a decrease in bias current passing through the remainder of the shunt connected diodes of the switch. This decrease of dc bias current passing through the remainder of the shunt connected diodes changes the operating point of these diodes and thereby causes a decrease in the isolation between the input and output of the microwave switch.

The above described loss of isolation in microwave p-i-n diode switches has long been a problem in the art resulting in prior art switches being capable of only switching under 20 watts of microwave power.

To solve the above described problem I provide novel circuitry for optimizing switching and dc bias conditions in a p-i-n diode microwave switch. With my novel circuitry isolation between the input and outputs of a microwave switch does not drop to unacceptable levels when microwave energy in excess of 20 watts is applied to the switch. More particularly, my novel circuitry isolates multiple shunt connected diodes in a microwave switch from each other so that a change in bias current flowing through one diode, particularly the first diode, does not effect the bias current flowing through other diodes in the switch. At the same time, the diodes do not appear to be isolated from each other with respect to microwave energy input to the switch.

My invention with its various advantages and features will appear more fully upon consideration of the attached drawings and the following detailed description thereof.

DETAILED DESCRIPTION

Figure 1:
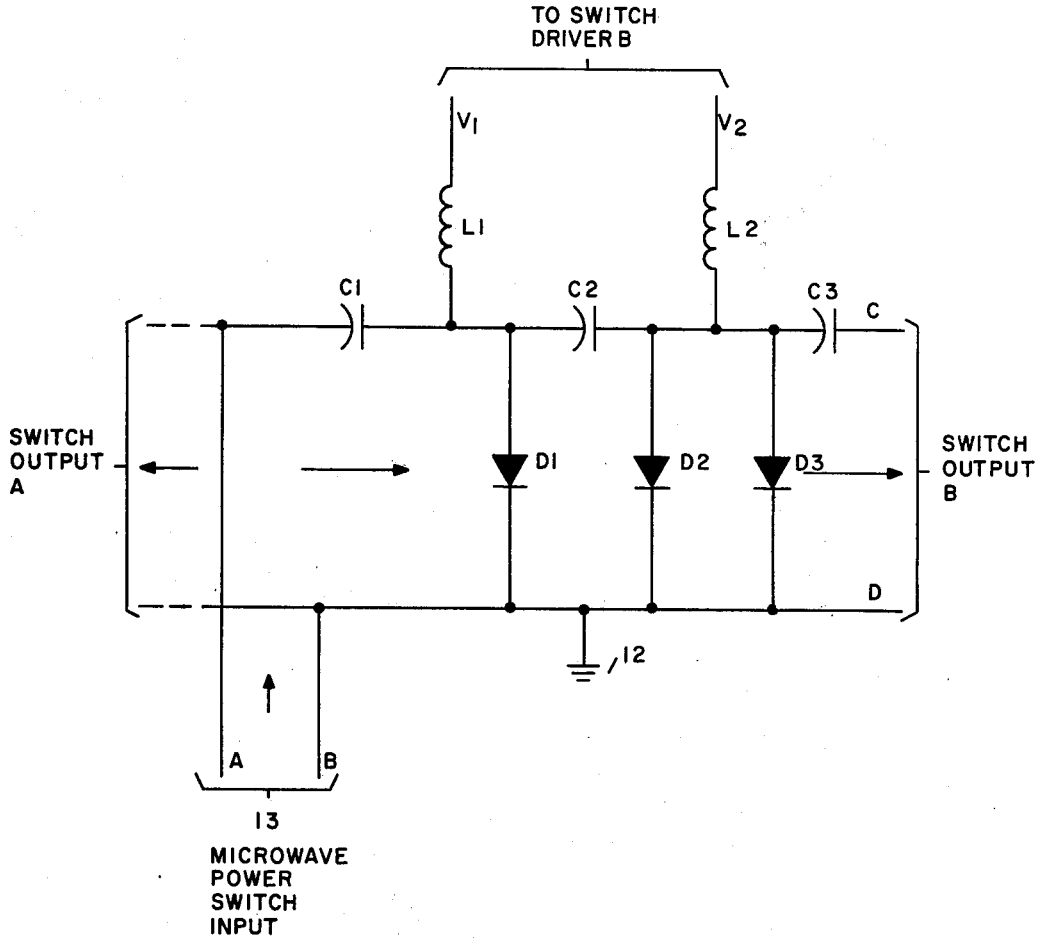
FIG. 1 is a schematic diagram of a p-i-n diode microwave switch incorporating the invention.

In FIG. 1 is shown a detailed schematic diagram of one branch of a conventional SPDT diode microwave switch equipped with my novel circuitry for switching the p-i-n diodes between their conducting and nonconducting states. The switch circuitry between the microwave power input 13 and switch output A is not shown as it is identical to the circuitry that is shown between input 13 and switch output B.

In the prior art a microwave switch using shunt connected p-i-n diodes and providing in the order of 60 db isolation between the input and output includes only diodes D1, D2 and D3, transmission line conductors C and D, ground potential 12, and inductor L1, all connected as shown in FIG. 1. Transmission lead D is grounded by ground potential 12 and a switching signal source is connected to transmission lead C via inductor L1 to apply switching potentials to diodes D1, D2 and D3 causing them to conduct and nonconduct to respectively place the switch in its open and closed states.

To solve the isolation problem of the prior art previously described, I first connect capacitors C1, C2 and C3 in series with transmission lead C in the switch as is shown in FIG. 1. I also provide a second inductor L2 to applying switching potentials to diodes D2 and D3. A first switching and bias signal is applied only via lead V1 and inductor L1 to diode D1 due to the dc isolation provided by capacitors C1 and C2. A second switching and bias signal is applied only via lead V2 and inductor L2 to diodes D2 and D3 due to the dc isolation provided by capacitors C2 and C3. With one switching and bias signal being applied to diode D1 and another to diodes D2 and D3 and the signals are blocked from each other by capacitors C1, C2 and C3, as diode D1 heats up it does not draw bias current from diodes D2 and D3 thereby lowering the isolation between switch input 13 and switch output B to below an acceptable level as occurred in the prior art. Capacitors C1, C2 and C3 and inductors L1 and L2 do not affect the operation of the switch as the capacitors appear as electrical short circuits to the microwave power passing through the switch and inductors L1 and L2 appears as electrical open circuits to the microwave power passing through the switch. The generation of the switching and bias potentials applied to leads V1 and V2 to place diodes D1, D2 and D3 in their conducting and nonconducting states is described in detail further in the specification.

Figure 2A:
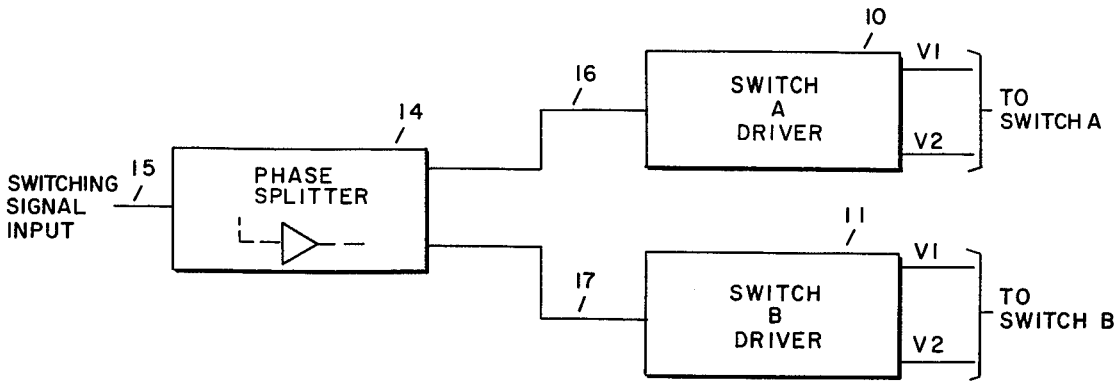
FIG. 2A is a block diagram of the switch driver elements used to drive a SPDT diode switch.

Turning now to FIG. 2A, therein is shown a block diagram of the apparatus required to drive a SPDT switch equipped with the novel switching and bias circuitry. Switch A driver 10 drives the switch circuitry (not shown) 1 switch output A of FIG. 1. while switch B driver 11 generates the switching and bias potentials on leads V1 and V2 necessary to operate the switch circuitry for switch output B. As a SPDT switch has only one of its two outputs open at any given time, drivers 10 and 11 must always be in opposite states from each other. Phase splitter 14 accomplishes this purpose. In operation of the switch a switching signal indicating the desired state of the SPDT microwave switch of FIG. 1 is applied to input 15 of phase splitter 14. Correspondingly, one output is applied to lead 16 while the inverse thereof is applied to lead 17 in a manner well known in the art. Thus, drivers 10 and 11 are always in opposite states from each other and the microwave power applied to input 13 of the microwave switch shown in FIG. 1 can only be output on either output A or output B of the switch.

Figure 2B:
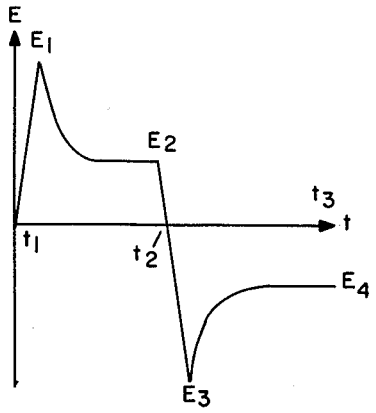
FIG. 2B is a waveform of a switching signal used in operation of the p-i-n diode switch incorporating the invention.

Turn now to FIG. 2B to discuss the waveform of the signals output from phase splitter 14 and drivers 10 and 11. The switching and bias signal shown in FIG. 2B is well known in the art. In one state of the switch, the output signal from phase splitter 14 on lead 16 looks like the positive waveform between times $t_1$ and $t_2$. Concurrently therewith, the output signal on lead 17 looks like the negative waveform between times $t_2$ and $t_3$. In the opposite state of the switch the signal output onto lead 16 is the negative waveform while the signal output onto lead 17 is the positive waveform. The switching and bias signals generated and output onto leads V1 and V2 from drivers 10 and 11 in response to the signals input thereto via leads 16 and 17 have the same waveform as the input signals but are of the increased amplitude necessary to drive the p-i-n diodes of the switch D1, D2, and D3.

The reason for the shape of the switching and bias signal shown in FIG. 2B is well known in the art but is briefly discussed here. The initial transient to amplitude E1 and E3 at the beginning of the positive and negative waveforms, respectively, is to rapidly change p-i-n diodes D1, D2 and D3 from their conducting state to their nonconducting state and vice versa. Following the transients bias potentials E2 and E4 are applied to the p-i-n diodes D1, D2 and D3 to bias them in either their conducting or nonconducting states, respectively. When it is desired to reverse the state of the p-i-n diodes in the microwave switch, the switching signal of the opposite polarity of the previously applied signal is applied to the diodes.

Figure 3:
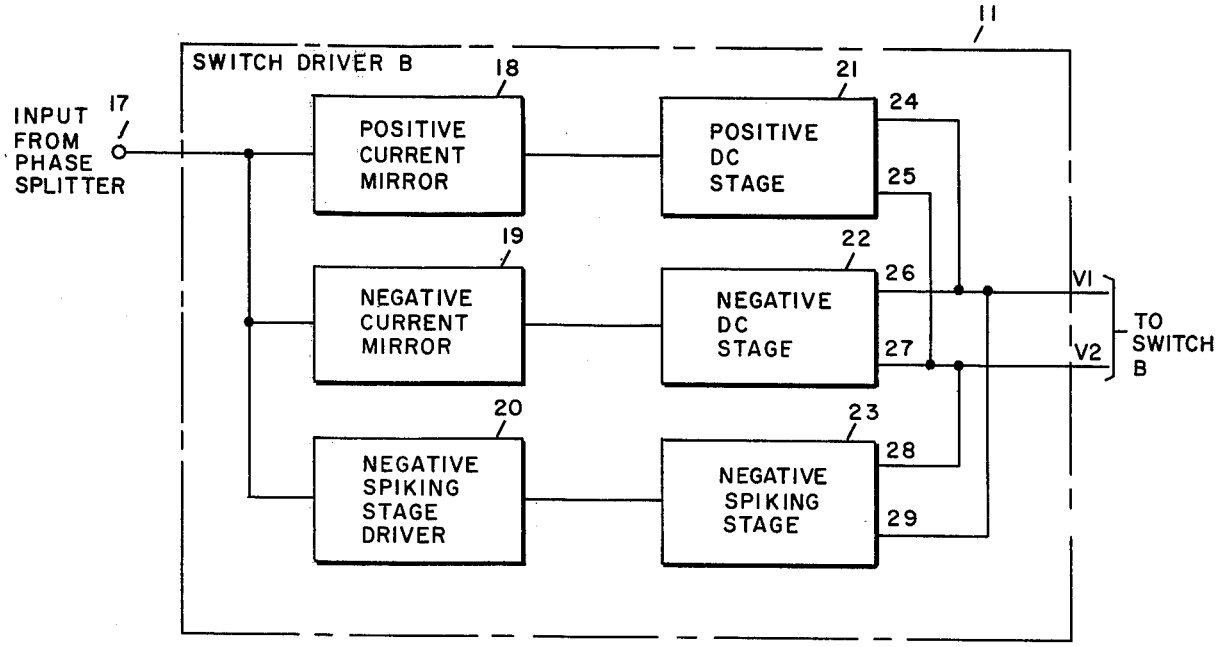
FIG. 3 is a detailed block diagram of the switch driver functioning with the invention.

In FIG. 3 is shown a detailed block diagram of switch driver 11 which is identical to switch driver 10 that is not shown. There is an input from phase splitter 14 via lead 17 whereon is present the switching waveforms just described. When the positive switching signal between times T1 and T2 of FIG. 2B is applied to the input of switch driver 11 via lead 17 the signal causes positive current mirror 18 to operate while causing negative current mirror 19 and negative spiking stage driver 20 to remain inoperative. Positive current mirror 18 generates an output to positive dc stage 21 causing stage 21 to provide an amplified output of the positive switching waveform shown in FIG. 2B to be output onto leads 24 and 25 which are connected respectively to leads V1 and V2. The output signal on lead 24 is applied via lead V1 to diode D1 of the microwave switch in FIG. 1. The output signal on lead 25 is applied via lead V2 to diodes D2 and D3 of the microwave switch in FIG. 1. The signal output onto lead 24 is of a much greater amplitude than the signal output onto lead 25 as diode D1 is the first diode upon which microwave power input to the switch impinges and, therefore, requires greater amplitude signals to be switched and remain biased in its conducting and nonconducting states.

Looking at FIG. 1, it can be seen that positive switching signals applied to leads V1 and V2 will forward bias diodes D1, D2 and D3 due to the presence of ground potential 12 on transmission lead D. As a result, diodes D1, D2 and D3 will conduct applying a short circuit across transmission leads C and D which reflects the microwave power back to input 13 and causes switch output B to be in its open state. As described previously, when diodes D1, D2 and D3 are conducting switch output B is open circuit and the circuitry of switch section A (not shown in FIG. 1) is closed circuit permitting the microwave power at input 13 to be output to a load (not shown) at switch output A.

At a later time when switch segment B is to be changed to its closed state, wherein diodes D1, D2 and D3 are not conducting, and microwave power at input 13 is present at switch output B, the negative switching signal between times $t_2$ and $t_3$ of FIG. 2B is applied to both leads V1 and V2. In FIG. 3, the negative switching signal is input to driver 11 via lead 17 and causes negative current mirror 19 and negative spiking stage driver 20 to be in their operative states while causing positive current mirror 18 to be in its inoperative state. Circuit 19 being in its operative state causes negative dc stage 22 to generate a high amplitude negative switching and bias signal that is applied via leads 26, 27, V1 and V2 to a p-i-n diodes D1, D2 and D3. Negative spiking stage driver 20 being in its operative state causes negative spiking stage 23 to generate a high amplitude transient slightly preceding transient E3 generated by negative dc stage 22. The transient from negative spiking stage 23 is applied via leads 28, 29, V1 and V2 to the p-i-n diodes of the switch to quickly change diodes D1, D2, and D3 to their nonconducting state by quickly depleting carriers from the junction of diodes D1, D2 and D3 in a manner well known in the art. Following the transient output from negative DC stage 22 which depletes any remaining carriers from the junction of the diodes there is a dc bias output therefrom of amplitude E4 used to maintain diodes D1, D2 and D3 in their nonconducting state while microwave power is incident thereon.

Figure 4:
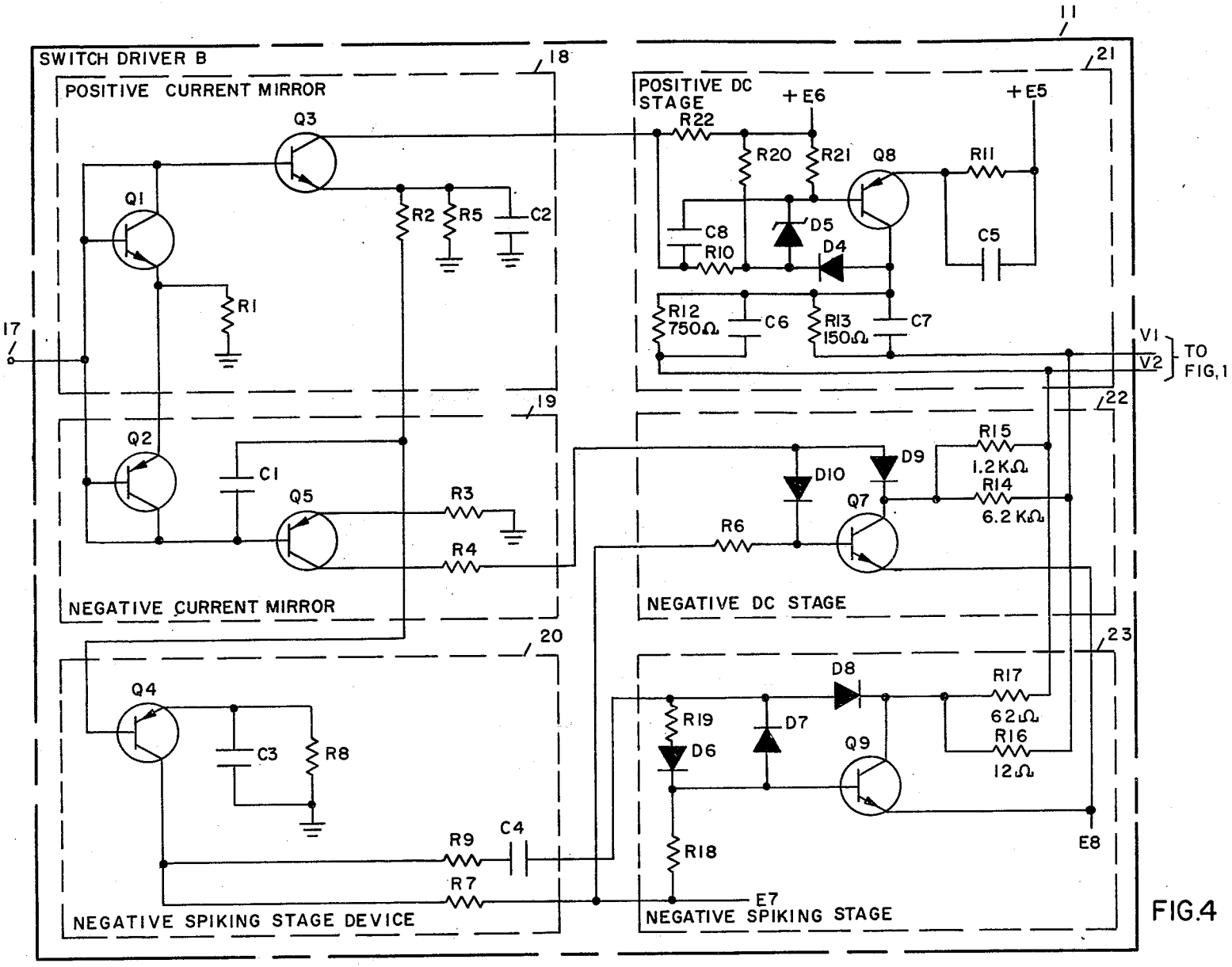
FIG. 4 is a detailed schematic diagram of the switch driver shown in FIG. 3.

Turning now to FIG. 4, therein is shown a detailed schematic diagram of switch driver 11. No detailed schematic of driver 10 is shown as it is identical to driver 11. The positive and negative switching and bias signals are input via lead 17 as previously described in the description of FIGS. 2A and 3. As previously described also, a positive switching and bias signal causes positive current mirror 18 to operate and causes negative current mirror 19 and negative spiking stage driver 20 to remain in their inoperative state. To accomplish this, the positive switching signal present on lead 17 forward biases transistor Q1 in positive current mirror 18 while reverse biasing transistor Q2. Transistor Q1 conducts which in turn forward biases transistor Q3 causing this transistor to conduct. The conduction of transistor Q3 of positive current mirror 18 causes transistor Q8 of positive dc stage 21 to conduct to amplify the positive switching and bias signal to the level required by diodes, D1, D2 and D3 in the microwave switch shown in FIG. 1. Capacitor C5 and resistor R11 connected to the emitter of transistor Q8 of positive dc stage 21 permit very rapid turn on of transistor Q8 to provide the high positive transient output required. The amplified positive switching waveform is present at the anode of diode D4 and is applied to the output network consisting of resistors R12 and R13 and capacitors C6 and C7. Resistor R13 has a much smaller value than resistor R12 and capacitor C7 has a much larger value than capacitor C6. It should be noted that resistor R13 and capacitor C7 couple the positive switching and bias signal to lead V1 and resistor R12 and capacitors C6 couple the positive switching signal to lead V2. Due to the relative values of the last mentioned components, the amplitude of the positive switching and bias signal output on lead V1 is of a much larger amplitude than that output on lead V2. This is necessary because a larger amplitude positive switching and bias signal must be applied to p-i-n diode D1 of the microwave switch in FIG. 1 to change diode D1 to its conducting state and maintain it in that state with high power microwave energy impinging thereon. It has been found that not as much microwave power is incident upon diodes D2 and D3 and, accordingly, they do not require a positive switching and bias signal of as large an amplitude in order to change these diodes to their conducting state and maintain them in that state. With diodes D1, D2 and D3 shorting transmission line conductors C and D in the switch, switch portion B is open and microwave power is reflected back toward the input. Particularly, the input microwave power will be output at switch output A at this time as described previously.

When microwave switch segment B is changed to its closed state p-i-n diodes D1, D2 and D3 are placed in their nonconducting state as described previously. To accomplish this a negative switching and bias signal is required. The required negative switching signal is applied via lead 17 to the input of switch driver B causing transistor Q1 of positive current mirror 18 to be reverse biased keeping this stage inoperative and forward biasing transistor Q2 and Q5 of negative current mirror 19, turning this stage on. With transistor Q5 conducting transistor Q7 in negative dc stage 22 conducts amplifying the negative switching signal which is then applied via resistors R14 and R15 to leads V1 and V2 respectively. The value of resistor R14 is of a lower value than resistor R15 to assure that the amplitude of the negative switching and bias signal applied to lead V1 is of a larger amplitude than the negative switching and bias signal applied to lead V2.

When transistor Q5 of negative current mirror 19 starts to conduct the change in conduction state causes a transient to be coupled through capacitor C1 to negative spiking stage driver 20. The transient causes transistor Q4 to conduct momentarily coupling the transient through capacitor C4 to negative spiking stage 23. The transient coupled via capacitor C4 causes transistor Q9 to conduct momentarily applying a high amplitude transient via resistors R16 and R17 to leads V1 and V2 respectively. Resistor R16 is of a lower resistance than resistor R17 so that a higher amplitude pulse is applied to lead V1 than to lead V2 for the reason described previously.

Negative spiking stage driver 20 and negative spiking stage 23 are utilized in addition to negative DC stage 22 to change diodes D1, D2, and D3 to their nonconducting state more rapidly than negative DC stage 22 can accomplish the function alone. Stages 20 and 23 which are designed only for transient signal amplification, unlike negative DC stage 22 which is designed for amplifying transients and dc bias levels, have faster rise times to produce the high amplitude output transient faster than stage 22.

While what has been described hereinabove is at present considered to be the preferred embodiment of the invention, it is illustrative only and it will be obvious to those skilled in the art that various changes and modifications may be made therein without departing from the scope of the invention as is claimed below.

I claim:

1. A switch having an input and an output with first and second transmission line conductors connected there between, a first and a second diode individually connected across said conductors, said first diode being connected across said conductors closer to said switch input than said second diode, means for generating a first control signal, means for generating a second control signal, first means for applying both said control signals to said first diode, second means for applying both said control signals to said second diode, said first control signal causing both said diodes to conduct to a place a short circuit connection across said conductors which prevents a radio frequency signal present at said switch input from being coupled via said conductors to said switch output, said second control signal causing both said diodes to be in their non-conducting state to place an open-circuit connection across said conductors which allows said radio frequency signal at said switch input to be coupled via said conductors to said switch output, first means for isolating said control signals applied to said first diode from said second diode so that changes in control signal created current flowing through said first diode will not affect control signal created current flowing through said second diode, second means for isolating said control signals from said switch input and said switch output, and means for causing division of control signal created current flowing through both said diodes such that a larger quantity of control signal created current flows through said first diode than through said second diode, as said first diode is closer to said switch input and has more current flowing therethrough due to said radio frequency signal.

2. The invention in accordance with claim 1 wherein said first diode and said second diode are forward biased into conduction by said first control signal and reverse biased into non-conduction by said second control signal.

3. The invention in accordance with claim 2 wherein said first control signal is of positive potential and said second control signal is of negative potential.

4. The invention in accordance with claim 1 wherein said first control signal generating means comprises first means for generating a transient potential that is applied to said first and said second diodes to cause said diodes to rapidly change to their conducting state from their non-conducting state so as to reduce power dissipation by said diodes while they are changing to their conducting state, and first means for generating a bias potential applied to said first and second diodes to maintain them in their conducting states.

5. The invention in accordance with claim 1 wherein said second control signal generating means comprises second means for generating a transient potential that is applied to said first and said second diode to cause said diodes to rapidly change to their non-conducting state from their conducting state so as to reduce power dissipation by said diodes while they are changing to their non-conducting state, and second means for generating a bias potential applied to said first and said second diodes to maintain them in their non-conducting state.

* * * * *